United States Patent [19]

Anderson

[11] Patent Number: 4,949,560

[45] Date of Patent: Aug. 21, 1990

[54] SHACKLE PROTECTIVE PADLOCK MOUNT

[75] Inventor: John P. Anderson, Norco, Calif.

[73] Assignee: The Hartwell Corporation, Placentia, Calif.

[21] Appl. No.: 454,736

[22] Filed: Dec. 20, 1989

[51] Int. Cl.[5] ..... F05B 67/38

[52] U.S. Cl. ..... 70/54; 70/2; 70/56

[58] Field of Search ..... 70/2–12, 70/54–56, 417, 418; 292/281–286

[56] References Cited

U.S. PATENT DOCUMENTS

| | | | |
|---|---|---|---|
| 1,248,293 | 11/1917 | Ellington . | |
| 1,690,041 | 10/1928 | Sundquist | 70/38 A |
| 3,572,062 | 3/1971 | Beebe | 70/15 |
| 3,727,438 | 4/1973 | Knaack | 70/63 |
| 3,953,062 | 4/1976 | Maston | 292/57 |
| 4,031,719 | 6/1977 | Klinger et al. | 70/56 |
| 4,033,155 | 7/1977 | De Lucia | 70/56 |
| 4,068,505 | 1/1978 | Volk | 70/56 |
| 4,095,828 | 6/1978 | East | 292/148 |
| 4,113,291 | 9/1978 | Cameron | 292/40 |
| 4,125,281 | 11/1978 | Dean et al. | 292/148 |
| 4,229,956 | 10/1980 | Thorburn | 70/129 |
| 4,238,941 | 12/1980 | Halapoff | 292/56 |
| 4,307,904 | 12/1981 | Daus | 292/148 |
| 4,437,692 | 3/1984 | Halopoff | 292/57 |
| 4,576,022 | 3/1986 | Gamble | 70/55 |
| 4,655,487 | 4/1987 | Korn et al. | 292/57 |
| 4,690,441 | 9/1987 | Fazzolari et al. | 292/57 |
| 4,745,783 | 5/1988 | Poe | 70/2 |
| 4,781,043 | 11/1988 | Loeffler | 70/54 |
| 4,788,836 | 12/1988 | Poe | 70/2 |

*Primary Examiner*—Robert L. Wolfe

*Attorney, Agent, or Firm*—Fulwider, Patton, Lee & Utecht

[57] ABSTRACT

A shackle protective padlock mount for use with a conventional padlock having a shackle of inverted U-shape with oppositely located legs. The mount includes a pair of shackle receivers adapted for attachment to the structures which are to be locked together. The receivers have openings for receiving the shackle. The receivers are constrained from moving apart by integral tabs which extend laterally outwardly of the respective receivers. The tabs are adapted to engage the oppositely located shackle legs to prevent separation of the receivers and deny access to the shackle by cutting tools or the like. The receivers are adapted to accommodate different sizes of shackles.

21 Claims, 3 Drawing Sheets

FIG. 1
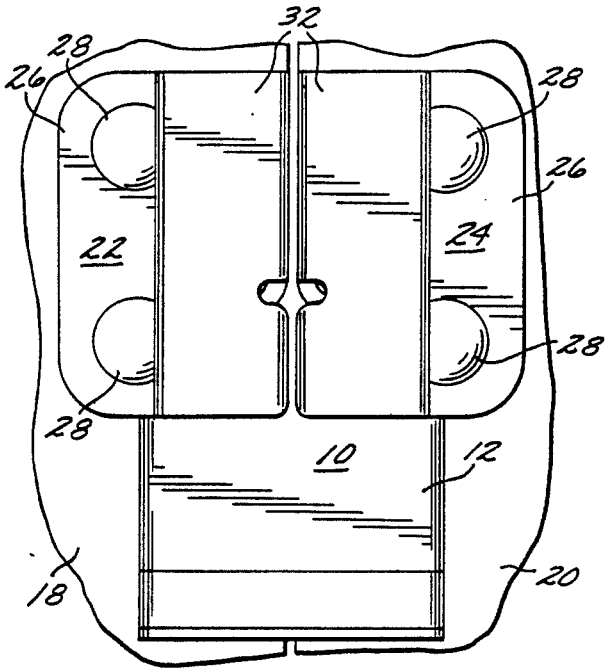
FIG. 3
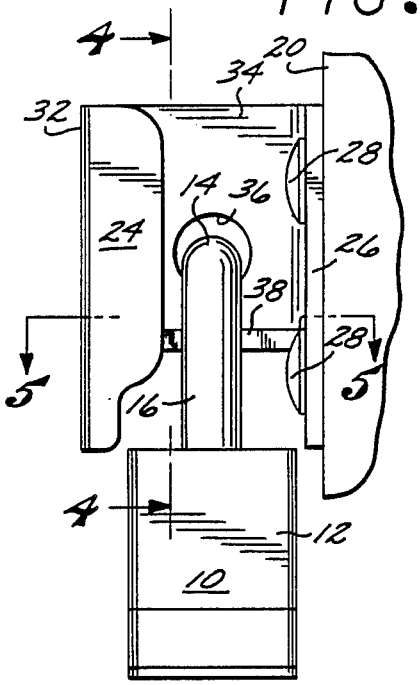
FIG. 2
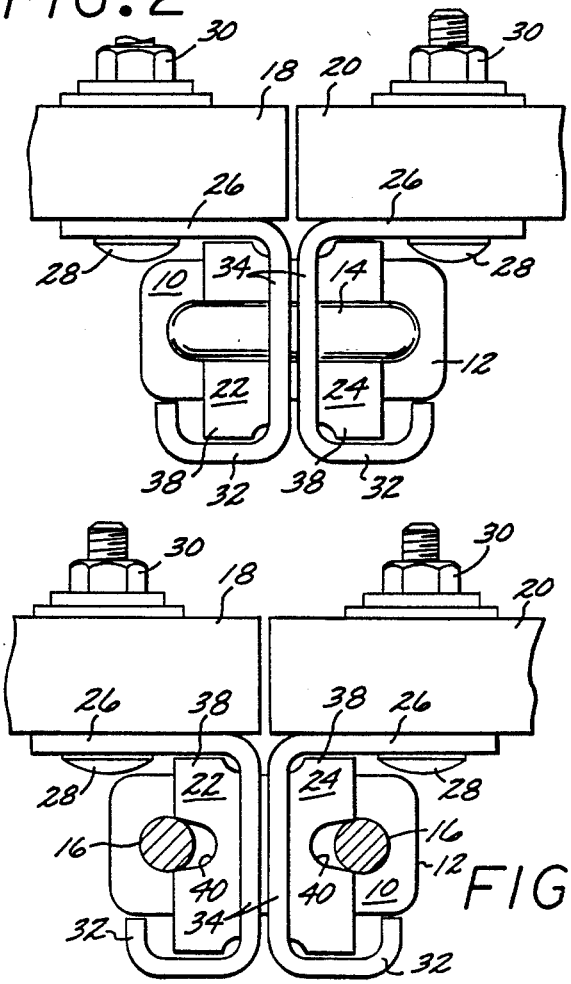
FIG. 5
FIG. 4
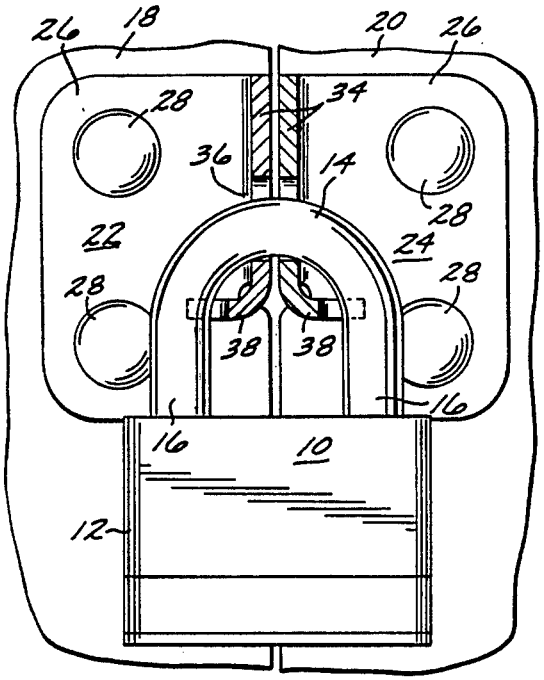

SHACKLE PROTECTIVE PADLOCK MOUNT

BACKGROUND OF THE INVENTION

1. Field of the Invention

The present invention relates to a padlock mount having portions which can be locked together to lock together the structures to which they are attached.

2. Description of the Prior Art

A common means to prevent doors and like structures from swinging or sliding apart is a padlock mount having a pair of shackle receivers attachable to such structures, with a padlock shackle fitted into complemental shackle openings in the receivers to lock them together.

The shackle openings have to be made of a generous size to accommodate the shackles of various sizes of padlocks, and also to enable the user to manipulate the U-shape shackle through the openings. If the doors are swinging doors and the door handles are pulled forcibly outwardly, the generous size shackle openings undesirably permit the receivers to be separated a significant distance. This is because the margins defining the shackle openings ride away from the bight of the shackle and onto the shackle legs. The degree of receiver separation is a function of the clearances between these edge margins and the bight of the shackle. If the clearances are large enough the receivers can be separated a distance approximating the spacing between the shackle legs. Such a gap is often sufficient to enable unauthorized persons to insert cutting tools and the like to cut the shackle, or to insert pry bars and develop a destructive leverage. It also would enable a tool to be inserted for hammering against the upper surface of the lock body to forcibly dislodge the shackle.

Reducing the shackle/shackle opening tolerance would reduce the degree of separation of the shackle receivers, but this would also mean that only one size of padlock could be accommodated. This undesirably limits the marketability of a padlock mount because the mount would have to be stocked in several sizes for various sizes of padlocks.

Of course, higher grade steel and heavier cross sections could be used for the various components of the lock and padlock mount, but this would add considerable expense to the locking system, and even such strengthened components are vulnerable to modern bolt cutters and the like.

The mount could also be provided with special protective covers, or be formed in some way that a portion would overlie and cover any gap between the receivers, but such measures would introduce a complexity in fabrication that would undesirably boost the cost of such a mount.

Whatever solution is devised, the resulting mount should also be capable of locking together doors and other structures which open by swinging or by sliding movement in a horizontal or a vertical direction, and it should be capable of receiving a padlock shackle from either the left or the right side. Desirably, it also should be capable of use in either an abutment or a mortise style installation.

SUMMARY OF THE INVENTION

A shackle protective padlock mount according to the present invention can be fitted to doors and other structures which swing or slide open vertically or horizontally. The mount includes a pair of complemental shackle receivers which include rear sections for attachment to the structures to be locked together, front sections to overlie and protect the padlock shackle, and special central sections which have generously sized shackle openings to receive the padlock shackles of various sizes of padlock.

The central sections include opposite, shackle leg engaging means, respectively, which extend laterally away from each other. In one embodiment these means take the form of horizontal tabs bent out of the material of the vertically oriented central sections. The tabs are located below the shackle openings and therefore are in a position to engage the shackle legs when the receivers are moved apart, as would occur if an attempt were made to open the structures to which the receivers are attached.

The tabs preferably include notches to closely receive the shackle legs. These notches are made larger in a laterally outward direction. This can be done by tapering each notch so that its edge margins progressively diverge outwardly. It can also be done by enlarging the notch step-wise or in increments in a laterally outward direction.

Larger size shackles of larger size padlocks have a larger diameter shackle and a greater spacing between their shackle legs. Such a shackle would engage the outer portions of the edge margins of the notch. Conversely, the smaller diameter shackles and smaller shackle leg spacing of smaller padlocks would cause such a shackle to engage the inner portions of the edge margins of the notch. Thus, the tabs are adapted to greatly limit the degree of separation of the shackle receivers regardless of the size of the padlock.

The shackle openings in the central sections of the receivers are preferably made larger in a downward direction to receive the shackles of either large or small padlocks. This raises the larger lock bodies into a protected position within the mount, and lowers the small lock bodies far enough in their unlocked state to permit the shackle to be pivoted for easy installation and removal.

The rear sections of the shackle receivers are laterally outwardly directed away from each other for attachment in an abutment style installation to the faces of the structures to be locked together. However, they can extend longitudinally rearwardly as a continuation of the central sections for attachment in a mortise style installation. Further, the fastener seats in the rear sections can be recessed to prevent insertion of a cutting chisel beneath the fastener heads.

Other objects and features of the invention will become apparent from consideration of the following description taken in connection with the accompanying drawings.

BRIEF DESCRIPTION OF THE DRAWINGS

FIG. 1 is a front elevational view of the shackle protective mount of the present invention, illustrated in association with a padlock, and attached to adjacent structures in an abutment style installation;

FIG. 2 is a top plan view of the mount of FIG. 1;

FIG. 3 is a right side elevational view of the mount of FIG. 1;

FIG. 4 is a view taken along the line 4—4 of FIG. 3;

FIG. 5 is a view taken along the line 5—5 of FIG. 3;

DESCRIPTION OF THE PREFERRED EMBODIMENTS

Figure 6:
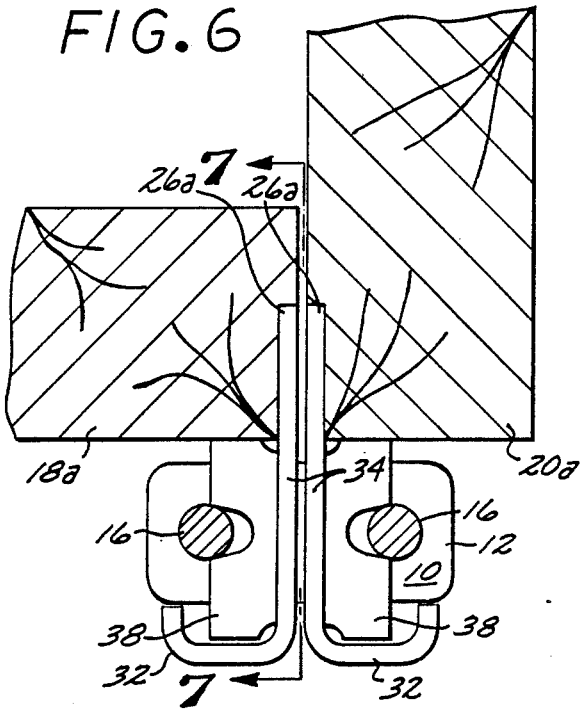
FIG. 6 is a view similar to FIG. 5, but illustrating a second embodiment in which the rear sections of the shackle receivers are configured to enable the mortise style installation which is illustrated.

Referring now to the drawings, one form of the present shackle protective padlock mount is illustrated in association with a conventional padlock 10 having a generally rectangular lock body 12 and a shackle of inverted U-shape having an upper portion or bight 14 integral with a pair of oppositely located shackle legs 16.

The padlock 10 is of conventional construction, the shackle leg 16 being shiftable or movable inwardly relative to the lock body 12 to a retracted position to place the padlock in a locked state. The legs are shiftable outwardly to an extended position when the padlock is unlocked. In the extended position one of the shackle legs, termed the "capture" leg, is located above and out of engagement with the lock body. This permits the shackle to be pivoted about the other or pivot leg to provide clearance for the shackle to be disposed through suitable shackle openings.

The present padlock mount is shown as it would appear when mounted to adjacent structures, such as garage doors 18 and 20, in an abutment style installation in which the rear faces of the mount are engaged or in abutment with the front faces of the doors.

The padlock mount comprises a pair of generally channel-shape shackle receivers 22 and 24. Although the receivers can be fabricated in any suitable manner, an inexpensive means of manufacture is to bend each receiver out of a single piece of heavy metal plate.

Each shackle receiver includes a substantially vertical, generally rectangular rear section 26. The sections 26 are attached, respectively, to the pair of doors 18 and 20 by suitable fasteners, such as four carriage bolts 28 fitted through square openings (not shown) in the rear sections 26, and extending through aligned openings in the doors 18 and 20. The threaded ends of the bolts 28 are secured by threaded nuts 30. In the abutment style installation illustrated the pair of rear sections 26 extend laterally outwardly away from each other.

Each shackle receiver also includes a substantially vertical, laterally outwardly directed front section 32 which overlies the front of the padlock shackle. Its lower portion or skirt extends downwardly and overlies and protects the upper portion of a padlock in its locked state.

Preferably the laterally outwardly directed portions of the front sections 32 have rearwardly directed extremities which extend on opposite sides of the shackle to narrow the opening between the free extremities of the front sections and the rear sections 26. Narrowing of this space is desirable to present as little room as possible for insertion of burglary tools.

Like the rear sections 26, the front sections 32 also extend laterally outwardly away from each other.

Each shackle receiver also includes a substantially vertical, longitudinally directed central section 34 which extends between the front and rear sections. Each central section includes a shackle opening 36 which is preferably made large enough to accommodate a range of different sizes of padlock shackles. A typical clearance between the shackle and the shackle opening is best seen in FIG. 3.

The attachment of the rear sections 26 to the doors 18 and 20 is such that the central sections 34 are located in very close proximity, and with their shackle openings 36 in alignment to receive the padlock shackle.

If one were to pull outwardly upon the swing mounted doors 18 and 20, the edge margins of the shackle openings would travel or ride downwardly away from the shackle bight 14 and closer to the inner surfaces of the shackle legs 16, as best seen in FIG. 4. The degree of such movement would depend upon the tolerance or spacing between the edge margins of the shackle opening and the shackle.

Any significant separation of the shackle receivers 22 and 24 at their central sections is very undesirable because the resulting gap would present an opening into which burglar tools and the like could be inserted for tampering with the shackle, for prying apart the receivers, or for imparting hammer blows upon the top of the lock body.

The padlock mount constrains and greatly limits the degree of any movement of the receivers away from one another by providing substantially horizontally oriented, opposite and laterally outwardly directed shackle leg engaging means in the form of a pair of standoff tabs 38. These are preferably formed by simply bending the lower portions of the central sections laterally outwardly, as best illustrated in FIG. 4.

Any attempt to open the doors 18 and 20, by moving them relative to one another through swinging or sliding, depending upon the style of mount, will act to move apart the central sections of the shackle receivers. This is immediately met and resisted by engagement of the tabs 36 with the inner surfaces of the shackle legs 16.

The tabs 38 are designed to provide this resistance for a variety of sizes of padlock. As best seen in FIGS. 5 and 8, each tab includes a laterally outwardly opening notch 40 whose edge margins are adapted to engage a shackle leg. The notch in the embodiments of FIGS. 1–8 is tapered so that its edge margins diverge laterally outwardly. The larger shackles 42, shown in phantom outline in FIG. 8, have a larger diameter and a greater spacing between their shackle legs. Such a larger shackle 42 would engage the outer edge margins of the notches 40. Conversely, smaller shackles, shown in phantom outline at 44, are characterized by a smaller diameter and a lesser shackle leg spacing, locating them in engagement with the inner edge margins of the notches 40. Thus, the tabs 38 are adapted to limit greatly any degree of separation of the shackle receivers 22 and 24 regardless of the size of the padlock.

Figure 7:
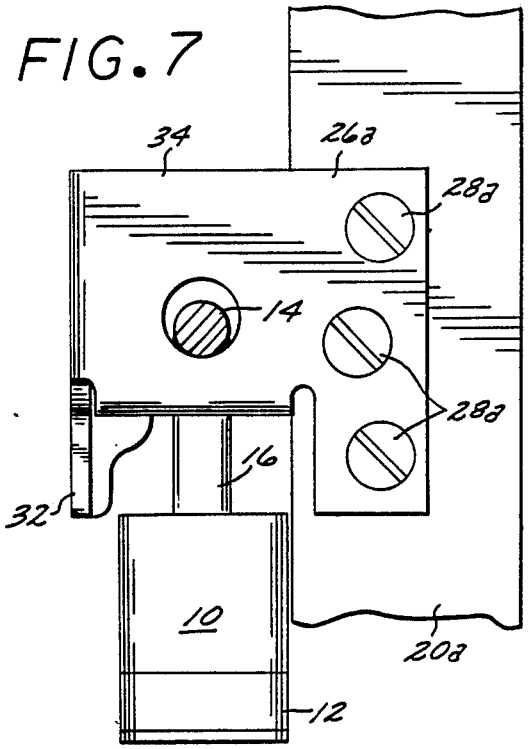
FIG. 7 is a view taken along the line 7—7 of FIG. 6.
Figure 8:
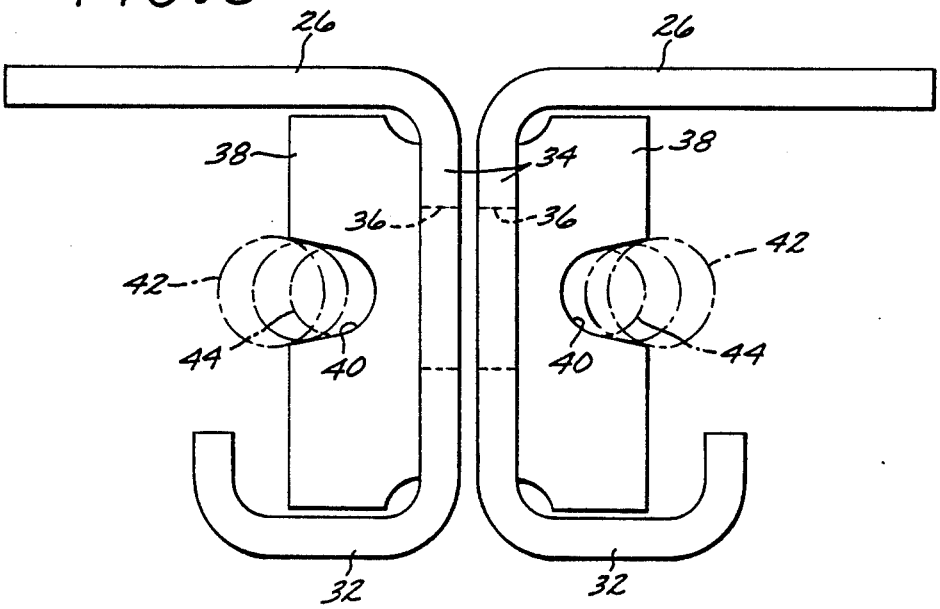
FIG. 8 is an enlarged top plan view of the shackle receivers of FIG. 1, illustrating the configuration of the notches in the shackle leg engaging tabs.

Referring now to FIGS. 6 and 7, a second embodiment of the present invention is illustrated which is very similar to the first embodiment. Like numerals are assigned for parts which are identical, while like numerals with the subscript "a" are assigned to modified parts performing essentially the same function. The primary difference between the first and second embodiments is the configuration and orientation of the rear sections 26*a*.

In the embodiment of FIGS. 6 and 7 the rear sections 26*a* are intended for use in a mortise style installation with structures such as doors 18*a* and 20*a*. In this application, the rear sections extend longitudinally rearwardly as a continuation of the central sections 34. They are provided with suitable openings having seats adapted to accept a plurality of slotted fastening screws 28*a* in flush relation with the adjacent surface of the rear section. In all other respects the function of the padlock mount is identical to that described previously.

Referring now to FIGS. 9–13, a third embodiment of the present invention is illustrated which is substantially identical to the first embodiment. Consequently, like numerals are assigned for parts which are identical, while like numerals with a subscript "b" are assigned to modified parts performing essentially the same function. The primary difference between this embodiment and the previous embodiments is the configuration of the shackle receiving openings in the central sections, and the configuration of the notches in the shackle leg engaging tabs. The number and seating of the fasteners is also somewhat different, as will become apparent.

Figure 11:
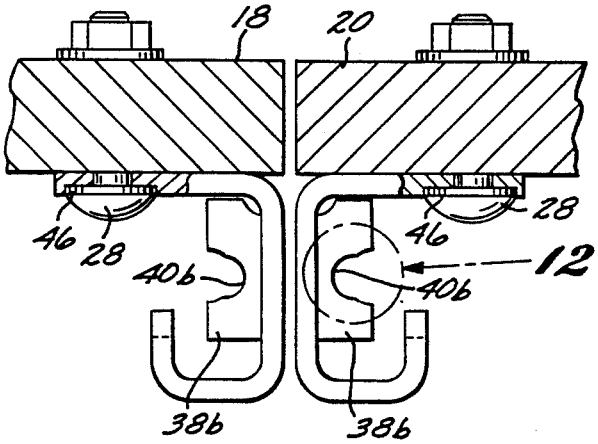
FIG. 11 is a view taken along the line 11—11 of FIG. 9.

More particularly, three fasteners or carriage bolts 28 are provided in each receiver rear section 26 and, as best seen in FIG. 11, each rear section is provided with a plurality of fastener seats or recesses 46 to closely receive the associated bolts 28, respectively. Seating of the heads of the bolts within the recesses 46 makes it extremely difficult for unauthorized persons to remove the bolts 28. The heads of the fasteners cannot be reached and sheared off by a chisel or the like, nor borken off with a prying tool.

Figure 12:
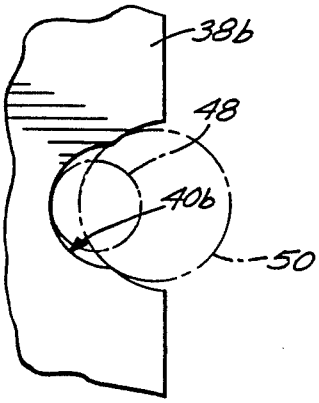
FIG. 12 is a detail view of the area in FIG. 11 designated by the numeral "12"

As seen in FIGS. 11 and 12, the notches which receive the shackle legs are no longer tapered, but are notches 40*a* enlarged step-wise or in increments in a laterally outward direction by cutting or otherwise arcuately forming the edge margins of the notches along successively larger circles. In the embodiment illustrated, the inner extremity of each notch 40*b* is semicircular, while the opposite margins of the outer portion are arcuately formed along a larger diameter circle. FIG. 12 illustrates the manner in which a smaller shackle leg 48 is received within the inner portion of the notch 40*b*, and in which a larger shackle leg 50 is received within the outer portion of the notch 40*b*.

Figure 9:
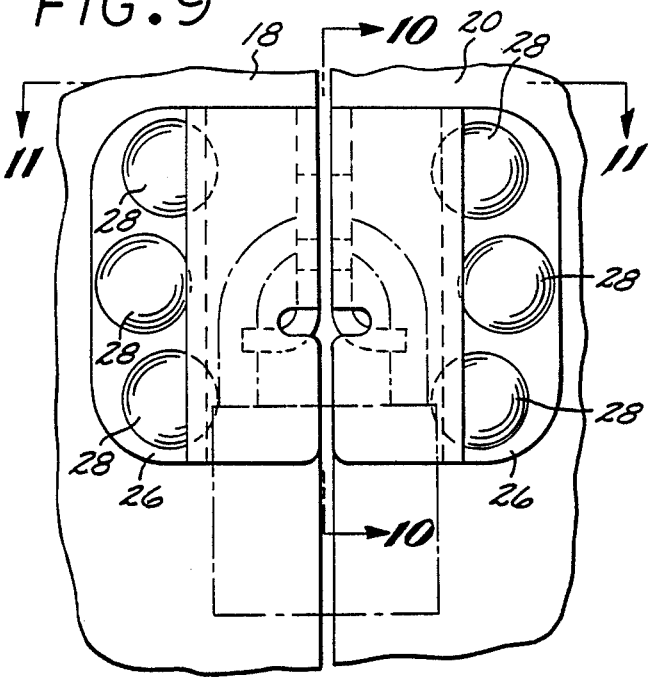
FIG. 9 is a view similar to FIG. 1, but illustrating a third embodiment in which the shackle openings in the central sections, and the notches in the shackle leg engaging tabs are differently configured.
Figure 10:
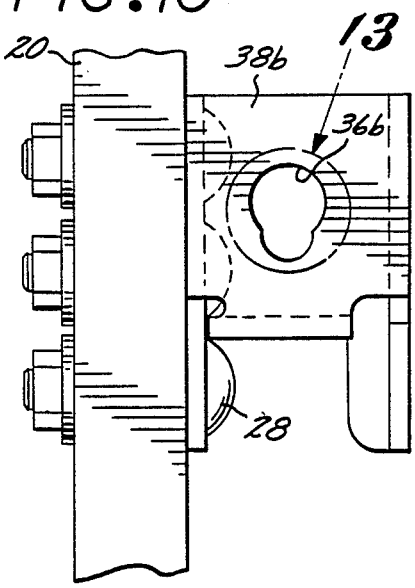
FIG. 10 is a view taken along the line 10—10 of FIG. 9.
Figure 13:
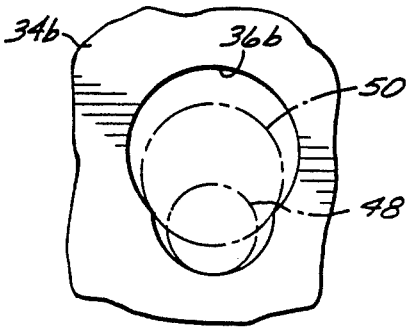
FIG. 13 is a detail view of the area in FIG. 10 designated by the numeral "13"
Figure 14:
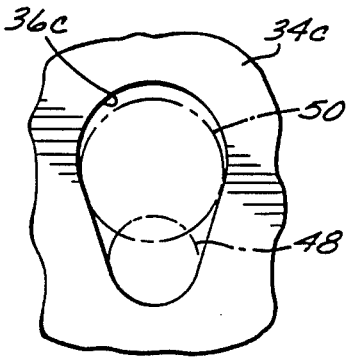
FIG. 14 is a view similar to FIG. 13, but illustrating a tapered shackle receiving opening in the center section.

With reference to FIGS. 9, 10 and 13, a similar configuration is provided for the shackle receiving openings in the receiver central sections. More particularly, the shackle receiving opening 36*b* has a larger diameter upper portion and a smaller diameter lower portion, providing a keyhole configuration. As best seen in FIG. 13, the upper portion of the opening 36*b* is thereby adapted to receive the shackle 50 of a larger padlock, while the lower portion of the opening is adapted to receive the shackle of a smaller padlock 48. FIG. 14 illustrates a variation in which an opening 36*c* is characterized by a larger diameter upper portion which tapers down to a smaller diameter lower portion.

The tapered or keyhole shaped openings 36*b* or 36*c* allow the use of padlocks having a wider range of shackle lengths and diameters. The wider or larger upper portion of the opening accommodates a lock having a longer, thicker shackle, and holds it in a position high enough to prevent the upper surface of the lock body from hanging below the lower portion or skirt of the receiver front sections 32 in the locked state of the padlock. The lower narrower portion of the opening prevents the larger padlock from dropping down below this protective skirt where it could be in a position of vulnerability.

The narrow or lower portion of the shackle openings is adapted to receive the shackle of a smaller lock so that the lock body is able to hang low enough in its unlocked state to clear the bottom edge of the receiver front sections 32, enabling the lock body to be pivoted about its pivot shackle leg for installation or removal of the lock.

From the foregoing it will be appreciated that both embodiments of the padlock mount are uniquely adapted to provide an economical and inexpensive means for restricting unauthorized access to a padlock shackle. The mount is relatively compact, convenient to install, and permits use of a range of sizes of conventional padlock. It does not require specialized hasps or lock bodies.

It will also be appreciated that the padlock mount can be oriented in various positions. In the foregoing description, reference has been made to "upper", "lower", "vertical", "horizontal", "right", "left", "front", "back", etc. These uses are with reference to the orientation of the padlock mount as seen in the drawing figures, but obviously the interpretation of these reference terms would be modified if the padlock mount were differently oriented. The claims which follow should be interpreted accordingly.

The material of the padlock mount and its thickness can be selected to suit the particular application at hand, the object being to make the dimensions of the mount such that they complement the dimensions of the particular installation.

Various modifications and changes may be made with regard to the foregoing detailed description without departing from the spirit of the invention.

What is claimed is:

1. A shackle protective padlock mount comprising:

a pair of complemental shackle receivers which include, respectively, central sections having shackle openings for receiving a padlock shackle having oppositely located shackle legs, the shackle receivers also including, respectively, rear sections for fixedly mounting the shackle receivers to adjacent structures to place the central sections in close proximity whereby a padlock shackle received in the shackle openings locks the adjacent structure together, the shackle receivers further including, respectively, front sections for protectively overlying the front of a padlock shackle received in the shackle openings, the central sections including oppositely and laterally outwardly directed shackle leg engaging means for engaging the shackle legs of a padlock shackle received in the shackle openings to constrain the central sections against movement out of their close proximity.

2. A shackle protective padlock mount according to claim 1 wherein the rear sections are oppositely and laterally outwardly directed for engagement of their rear surfaces with the adjacent structures.

3. A shackle protective padlock mount according to claim 1 wherein the rear sections are rearwardly directed for engagement of their laterally outward surfaces with the adjacent structures.

4. A shackle protective padlock mount according to claim 1 wherein the front sections include laterally outwardly directed portions having rearwardly directed extremities for protectively overlying portions of the sides of a padlock shackle received in the shackle openings.

5. A shackle protective padlock mount according to claim 1 wherein each shackle leg engaging means is defined by a tab integral with and formed out of the associated central section.

6. A shackle protective padlock mount according to claim 5 wherein the front and rear sections are substantially vertically oriented, except for the tab, which is substantially horizontally oriented.

7. A shackle protective padlock mount according to claim 5 wherein each tab includes a laterally outwardly opening notch whose edge margins are adapted to engage a shackle leg.

8. A shackle protective padlock mount according to claim 7 wherein the notch becomes larger in a laterally outward direction for engagement with shackle legs of different diameters.

9. A shackle protective padlock mount according to claim 7 wherein the edge margins of the notch are tapered to diverge laterally outwardly to form a progressively larger notch in an outward direction.

10. A shackle protective padlock mount according to claim 7 wherein the edge margins of the notch lie along progressively larger circles in an outward direction whereby a smaller diameter shackle leg as complementally receivable in the inner portion of the notch, and a larger diameter shackle leg is complementally receivable in the outer portion of the notch.

11. A shackle protective padlock mount according to claim 1 wherein the rear sections include fastener openings having enlarged seats for receiving headed fasteners in the fastener openings, respectively, with the heads of the fasteners partially recessed in the seats.

12. A shackle protective padlock mount according to claim 1 wherein each shackle opening becomes smaller in a downward direction for receiving shackles of different diameters.

13. A shackle protective padlock mount according to claim 12 wherein the edge margins of the shackle opening are tapered to converge downwardly to form a progressively smaller opening in a downward direction.

14. A shackle protective padlock mount according to claim 12 wherein the edge margins of the shackle opening lie along progressively smaller circles in a downward direction whereby a larger diameter shackle is complementally receivable in the upper portion of the shackle opening, and a smaller diameter shackle is complementally receivable in the lower portion of the shackle opening.

15. A shackle protective padlock mount in combination with a padlock of inverted U-shape having oppositely located shackle legs, the mount comprising:

a pair of shackle receivers which each include a substantially vertical rear section for attachment to one of a pair of structures to be locked together, a substantially vertical, laterally outwardly directed front section overlying the front of the padlock shackle, and a substantially vertical, longitudinally directed central section extending between the front and rear sections and including a shackle opening, the respective front sections extending oppositely of one another, the respective central sections being located in close proximity with their shackle openings aligned and receiving the padlock shackle, and the central sections including substantially horizontal, oppositely and laterally outwardly directed shackle leg engaging means engaging the shackle legs and constraining the central sections against movement out of their close proximity.

16. The combination of claim 15 wherein the rear sections are laterally outwardly directed oppositely of one another for engagement with the pair of structures, respectively.

17. The combination of claim 15 wherein the rear sections are rearwardly directed, and form continuations of the central sections, respectively, for engagement of their laterally outward faces with the pair of structures, respectively.

18. The combination of claim 15 wherein each shackle leg engaging means is defined by a tab integral with and formed out of the associated central section.

19. The combination of claim 18 wherein each tab includes a notch having edge margins engaging the associated shackle leg.

20. The combination of claim 19 wherein the notch becomes larger in a laterally outward direction for engagement with shackle legs of different diameters.

21. The combination of claim 15 wherein each shackle opening becomes smaller in a downward direction for receiving shackles of different diameters.

* * * * *